US006026892A

United States Patent [19]

Kim et al.

[11] Patent Number: 6,026,892

[45] Date of Patent: Feb. 22, 2000

[54] HEAT TRANSFER TUBE WITH CROSS-GROOVED INNER SURFACE AND MANUFACTURING METHOD THEREOF

[75] Inventors: Pyung Gon Kim; Kill Soon Kwak, both of Ulsan, Rep. of Korea

[73] Assignee: Poongsan Corporation, Rep. of Korea

[21] Appl. No.: 08/927,542

[22] Filed: Sep. 11, 1997

[30] Foreign Application Priority Data

Sep. 13, 1996 [KR] Rep. of Korea ..... P96-39757

[51] Int. Cl.[7] ..... F28F 1/40

[52] U.S. Cl. ..... 165/133; 165/184

[58] Field of Search ..... 165/133, 184, 165/179

[56] References Cited

U.S. PATENT DOCUMENTS

| | | | |
|---|---|---|---|
| 4,733,698 | 3/1988 | Sato | 165/179 X |
| 4,809,415 | 3/1989 | Okayama et al. | 165/133 X |
| 5,052,476 | 10/1991 | Sukumoda et al. | 165/133 |
| 5,332,034 | 7/1994 | Chiang et al. | 165/184 |

FOREIGN PATENT DOCUMENTS

| | | | |
|---|---|---|---|
| 150799 | 9/1982 | Japan | 165/133 |
| 119192 | 7/1984 | Japan | 165/184 |
| 314898 | 12/1989 | Japan | 165/184 |
| 186196 | 8/1991 | Japan | 165/184 |
| 189013 | 8/1991 | Japan | 165/184 |
| 207995 | 9/1991 | Japan | 165/184 |

*Primary Examiner*—Leonard Leo
*Attorney, Agent, or Firm*—Burns, Doane, Swecker & Mathis, L.L.P.

[57] ABSTRACT

A heat transfer tube with a cross-grooved inner surface used in refrigerators, air conditioners or the like and a manufacturing method thereof are disclosed. The heat transfer tube is formed in such a manner that the helix angle α of a primary spiral groove to the longitudinal axis of the tube is in the range of 10° to 40°, the intersecting angle β of a secondary groove to the primary spiral groove is in the range of 75° to 105°, the ratio H/Hf of a height H of the secondary groove to a height Hf of the primary spiral groove is in the range of 0.5 to 1.0, the slope angle $\gamma_1$ of an upstream slant face is in the range of 90° to 105° to the direction of the primary spiral groove, the slope angle $\gamma_2$ of a downstream slant face is in the range of 30° to 60° to the direction of the primary spiral groove, and the ratio A/B of a width A of an upper surface of the ridge formed between the primary and secondary grooves to a width B of an upper opening portion of the secondary groove is in the range of 0.2 to 1.0.

4 Claims, 6 Drawing Sheets

HEAT TRANSFER TUBE WITH CROSS-GROOVED INNER SURFACE AND MANUFACTURING METHOD THEREOF

BACKGROUND OF THE INVENTION

1. Field of the Invention

The present invention relates generally to a heat transfer tube for a heat exchanger, and more particularly to a heat transfer tube with cross-grooved inner surface in order to improve the fluidity and the heat transfer characteristic thereof.

2. Description of the Prior Art

As heat exchangers, such as vaporizing tubes, condensing tubes or heat pipes, for use in air conditioners, refrigerators or the like, to evaporate or condense the refrigerant flowing inside the tube by heat transferring with fluids flowing outside the tubes, internally grooved heat transfer tubes have mainly been used from the standpoint of attaining high efficiency and energy saving.

Because fine triangular or trapezoid grooves are formed spirally in the inner surface of the tubes, the flow of refrigerants along the longitudinal direction of the tubes is promoted by turbulent flows due to the surface tension effects and the spiral grooves of the tubes. When used in the condensers, these heat transfer tubes produce superior turbulent flow of the refrigerant to improve the condensation characteristic, because a ridge formed between grooves serves as a condensing nucleus. Otherwise, when used in the evaporators, the vaporizing characteristic of the refrigerant supplied into the heat transfer tube is improved with the stirring action occurring at the edges of the grooves, in which the edge of the groove serves as a vaporizing nucleus.

U.S. Pat. No. 4,658,892 issued to Shinohara et al., ("Shinohara") on Apr. 21, 1987 discloses a heat transfer tube having relatively deeper grooves on the inner surface of the tube within a range in which the pressure loss of fluid inside of grooved tube is not substantially increased. According to Shinohara, the ratio Hf/Di of the depth Hf of the grooves to the diameter Di of the inner surface of the tube is 0.02 to 0.03, and the helix angle β of the grooves to an axis of the tube is 7° to 30°. The ratio S/Hf of the cross-sectional area S of respective grooved section to the groove depth Hf ranges from 0.15 to 0.40, and the apex angle in cross-section of a ridge located between the respective grooves ranges from 30° to 60°.

In the heat transfer tube disclosed in Shinohara, the refrigerant fluid supplied into the tube becomes more widely distributed over the entire inner surface of the tube along the continuous helix grooves, leading to deterioration of the condensation efficiency.

In order to improve the heat transfer characteristic, it have been proposed that a heat transfer tube with a number of secondary grooves intersecting the primary spiral grooves at a desired angle and spacing at a constant interval. See U.S. Pat. No. 4,733,698 issued to Sato et al. ("Sato") on Mar. 29, 1988.

For example, FIG. 9A illustrates the heat transfer tube with secondary grooves 12 intersecting first primary grooves 11 at a desired angle, in which the secondary grooves are sloped at a helix angle larger than helix angle of the first spiral grooves.

In such cross-grooved heat transfer tubes, the internal surface area increased by the secondary grooves 12 improves heat transfer efficiency. Also, due to the helix angle of the secondary grooves being larger than the helix angle of the primary grooves with respect to the axial direction of the tube, as well as the increase of the number of the edges in the tube, the stirring action for the refrigerant fluid increases. Therefore, the evaporation characteristic of the refrigerant fluid is improved, resulting in the spread of the application range, gradually.

In the conventional cross-grooved heat transfer tube, however, a current of the fluid moving against the main current and with a circular motion (hereinafter referred to as "eddy") is produced on the downstream slant face of the ridge 13 in the secondary groove 12 formed between the ridges 13, as illustrated in FIGS. 9B and 9C. The production of the eddy gives resistance to the flowing direction of the refrigerant fluid inside the tube, resulting in deterioration of heat transfer characteristic in the eddy producing area.

Also, when manufacturing the heat transfer tube described above, the first spiral grooves 11 are roll-formed, and then the secondary grooves 12 are roll-formed. Accordingly, protrusions 14 are protruded on both sides of the spiral grooves 11, which are already formed, in roll-forming the secondary grooves. The protrusions 14 formed due to the above method causes the flowing resistance to increase, thereby deteriorating the turbulent effects produced by the spiral grooves. Accordingly, although the conventional cross-grooved heat transfer tube has a superior heat transfer characteristic, such effect comes at the cost of a significant pressure loss inside the tube.

In order to overcome the problem described above, Japanese Patent Unexamined Publication No. 94-147786 discloses a heat transfer tube in which the primary grooves are formed on the tube's internal surface in the shape of a rectangle or an inverted trapezoid with a constant depth H and a constant pitch P along the longitudinal direction of the tube, and secondary grooves with a depth shallower than the primary grooves' depth are formed in a direction intersecting the primary grooves. In the primary grooves, the ratio S/P of width S of the bottom to the pitch P is below ½, and the ratio L/S of the depth L to the width S is above ½.

As described above, although the heat transfer characteristic may be improved, if the pressure loss increases, substantially increase in power is needed to let the refrigerant fluid flow in the tube. Therefore, it would be disadvantageous that the conventional heat transfer tube has the heat transfer characteristic in inverse proportion to the energy efficiency.

SUMMARY OF THE INVENTION

An object of the present invention is to overcome the problems described above with the conventional heat transfer tube and to provide a heat transfer tube with cross-grooved inner surface capable of improving the heat transfer characteristic without increasing the pressure loss and a manufacturing method thereof.

In order to achieve the above object, according to one aspect of the present invention, a heat transfer tube is provided with a cross-grooved inner surface comprising: a plurality of primary spiral grooves spaced in parallel to each other at a helix angle to a longitudinal axis of the tube; a plurality of secondary grooves spaced in parallel to each other and intersecting the primary spiral grooves at an intersecting angle to the direction of the primary spiral grooves to form a plurality of ridges between adjacent secondary grooves and adjacent primary spiral grooves; and the helix angle of the primary spiral groove to the longitudinal axis of the tube being in the range of 10° to 40°, and the intersecting angle of the secondary groove to the primary spiral groove being in the range of 75° to 105°; the secondary groove having an upstream slant face at a nearly right angle and a downstream slant face at an angle to the direction of the primary spiral groove; the ratio A/B of a width A of an upper surface of the ridge to a width B of an upper opening portion of the secondary groove being in the range of 0.2 to 1.0.

Preferably, a slope angle of the upstream slant face and a slope angle of the downstream slant face are respectively in the range of 90° to 105° and the range of 30° to 60° to the direction of the primary spiral groove.

And preferably, a ratio H/Hf of a height H of the secondary groove to a height Hf of the primary spiral groove is in the range of 0.5 to 1.0.

The helix angle of the primary spiral groove to the longitudinal axis of the tube is in the range of 18° to 25°, and the intersecting angle of the secondary groove to the primary spiral groove is substantially 90°.

According to another aspect of the present invention, it is provided with a method of manufacturing heat transfer tube with a cross-grooved inner surface, on the entire inner surface in which a plurality of primary spiral grooves which are spaced in parallel to each other and have a desired helix angle to a longitudinal axis of the tube are formed in the shape of a triangle or adverted trapezoid, and a plurality of secondary grooves which intersect the primary spiral grooves at desired angle and have an intersecting angle larger than the helix angle of the primary spiral grooves are formed, the method comprising steps of: swaging a plain flat metal strip with a given width between a plain roller and a secondary grooved roller to form the plurality of the secondary grooves; swaging the metal strip having the plurality of the secondary grooves between a plain roller and a primary spiral grooved roller to form the plurality of the primary spiral grooves; forming the swaged metal strip into a shape of tube with a primary spiral grooved and secondary grooved surface facing an interior of the tube; and welding two longitudinal adjacent edge portions of the formed metal strip.

The helix angle of the primary spiral groove to the longitudinal axis of the tube is in the range of 10° to 40°, preferably 18° to 25°, and the intersecting angle of the secondary groove to the primary spiral groove is in the range of 75° to 105°, preferably 90°.

Wherein the secondary groove having an upstream slant face at a nearly right angle and a downstream slant face at an angle to the direction of the primary spiral groove.

A slope angle of an upstream slant face and a slope angle of a downstream slant face of the secondary grooves are respectively in the range of 90° to 105° and the range of 30° to 60° to the direction of the primary spiral groove.

BRIEF DESCRIPTION OF THE DRAWINGS

The above object, other features, and advantages of the invention will become apparent by describing the preferred embodiment thereof with reference to the accompanying drawings, in which:

FIGS. 9 show one cross-grooved heat transfer tube of prior art.

DETAILED DESCRIPTION OF THE PREFERRED EMBODIMENT

Figure 1:
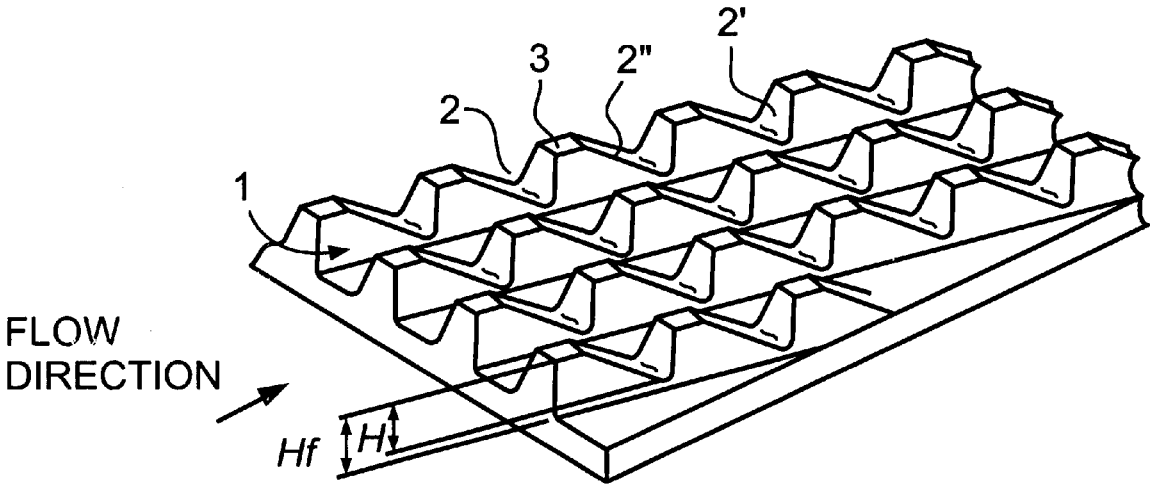
FIG. 1 is an enlarged perspective view illustrating the heat transfer tube according to the present invention with a cross-grooved inner surface.
Figure 2:
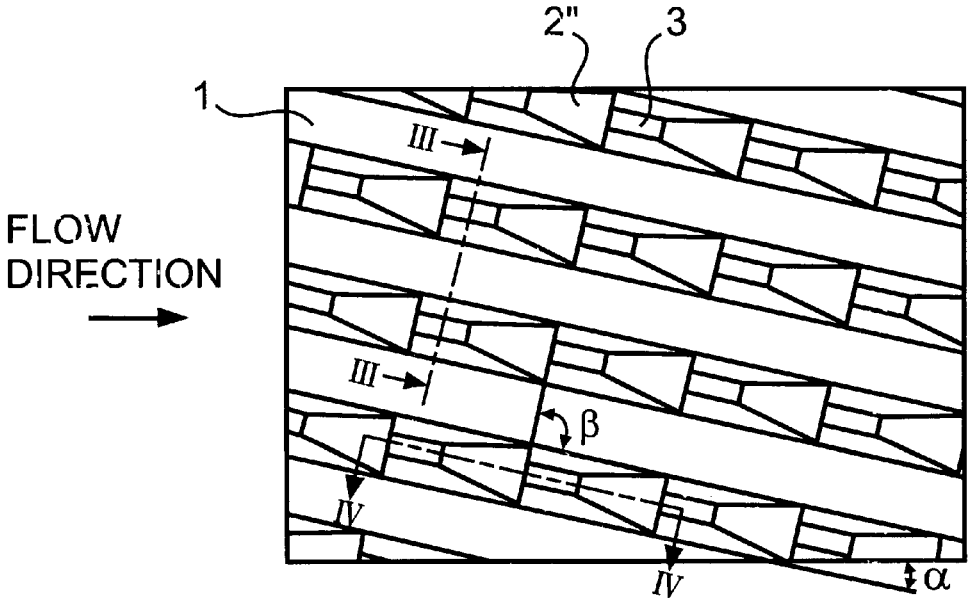
FIG. 2 is a top plan view of the heat transfer tube in FIG. 1.
Figure 3:
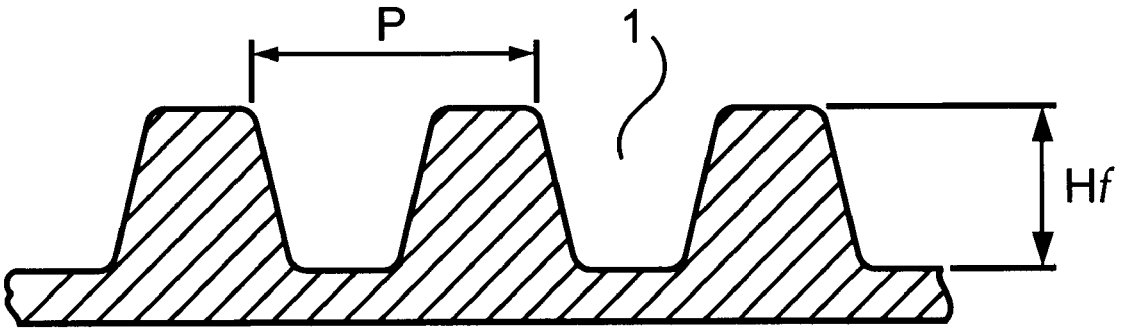
FIG. 3 is a cross sectional view taken along line III—III of FIG. 2 to show the cross sectional shape of primary spiral grooves.

The cross-grooved heat transfer tube according to the present invention is a tube having circular cross section and is formed on the entire internal surface thereof a number of primary spiral grooves 1 parallel to each other, in which the grooves 1 have a constant helix angle $\alpha$ to the longitudinal axis of the tube. The cross sectional shape of the spiral groove 1 is an inverted trapezoid as shown in FIG. 3. Also, on the entire internal surface of the cross-grooved heat transfer tube, there is formed a number of secondary grooves 2 intersecting the primary spiral grooves 1 at a constant angle $\beta$ to the direction of the primary spiral groove 1. The cross sectional shape of the secondary groove 2 is a substantial triangle with an intersecting angle larger than that of the primary spiral groove 1 as shown in FIG. 2. A number of fine ridges 3 are formed in the cross sectional shape of a trapezoid on the inner surface of the tube by the primary spiral grooves 1 and secondary grooves 2.

The heat transfer tube may be made of the common material, such as copper, copper alloy, aluminum, aluminum alloy or the like, and the width and thickness of a metal strip used in the manufacture of the tube may be selected depending on the usage.

Figure 5:
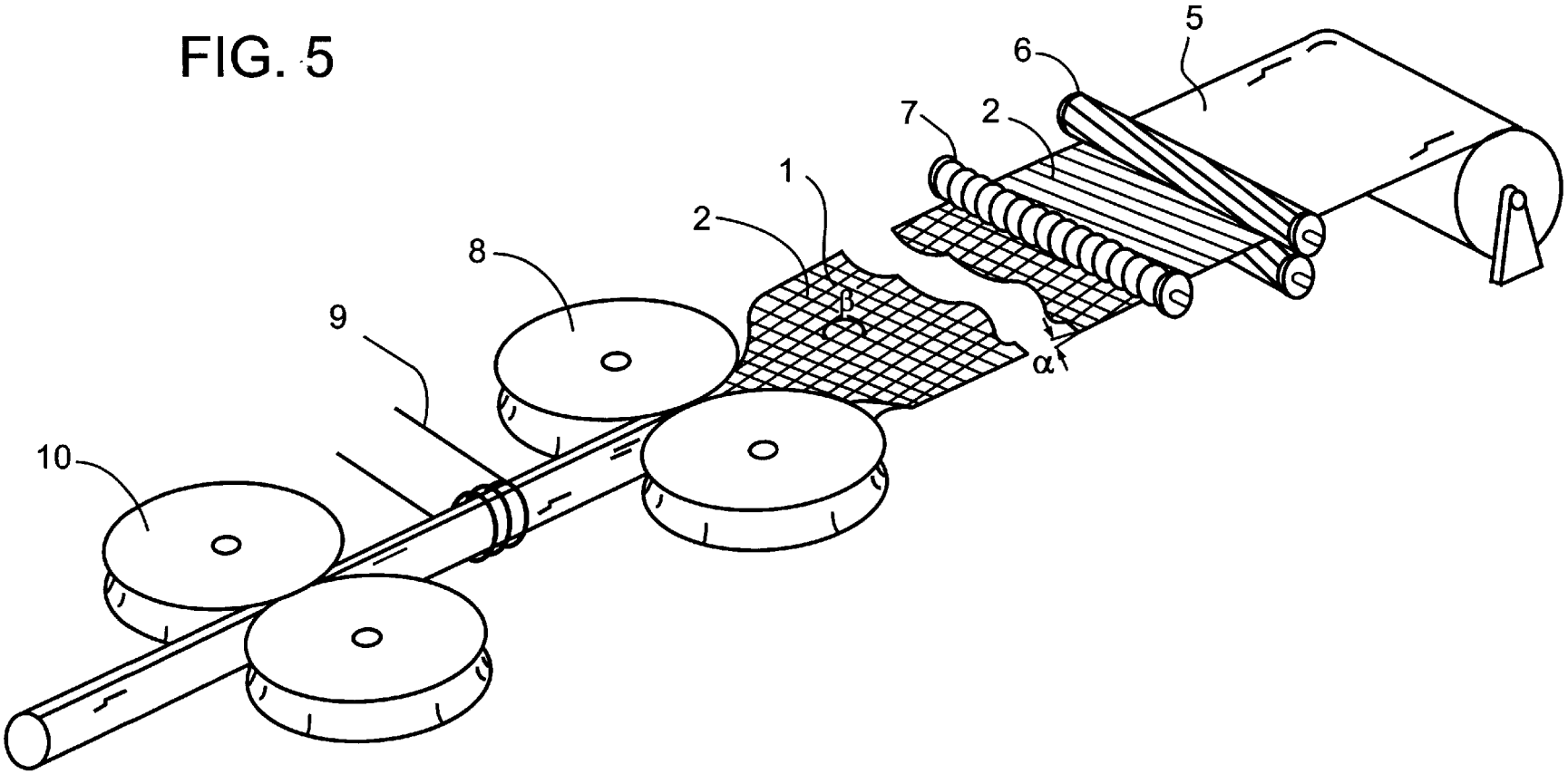
FIG. 5 is a perspective view illustrating a method of manufacturing the heat transfer tube with a cross-grooved inner surface according to the present invention.

In the embodiment as shown in FIG. 5, the primary spiral grooves 1 are formed after the formation of the secondary grooves 2, and thus the cross sectional shape of the tube is a triangle or a trapezoid such as a conventional cross-grooved heat transfer tube. The helix angle $\alpha$ of the primary spiral groove 1 to the longitudinal axis of the tube, i.e., the angle to the flowing direction of the refrigerant fluid is in the range of 10° to 40°, and preferably in the range of 18° to 25°. If the helix angle of the primary spiral groove is less than 10°, it is difficult to expect the turbulence effect provided by the primary spiral groove. Also, the deterioration of the eddy producing effect for the refrigerant fluid leads to lower heat transfer characteristic. Meanwhile, if the helix angle is greater than 40°, the flowing resistance against the primary spiral groove is increased rapidly, resulting in the pressure loss inside the tube.

Preferably, the pitch of the primary spiral groove is in the range of 0.2 to 0.7 mm for a tube having a 1 cm inner diameter. If the pitch P is very large, the density of the primary spiral grooves is small, so that the fluidity of the refrigerant fluid and the heat transfer characteristic are decreased. On the other hand, if the pitch P is very small, it is difficult to form the grooves. Accordingly, in case of general heat transfer tubes with an inner diameter of about 1 cm, a proper pitch will be selected from a range of 0.2 to 0.7 mm.

Also preferably, the ratio Hf/Di of the height Hf of the primary spiral groove 1 to the inner diameter Di of the tube is between from 0.02 to 0.05. If the ratio of the height of the primary spiral groove to the inner diameter of the tube is below 0.02, because the effect of the spiral grooves is not applied to the inner surface of the tube, it is difficult to expect the surface tension and the turbulence effect due to the spiral grooves. On the other hand, if the ratio Hf/Di is above 0.05, the flowing resistance by the spiral grooves increases, resulting in decreasing the fluidity.

According to the present invention, the secondary grooves 2 are formed in parallel to each other and intersect the primary spiral grooves 1. The cross grooves prevent the distribution of the refrigerant fluid by the continuous spiral grooves and further improves the turbulent and stirring effects of the refrigerant fluid produced by the spiral grooves. The intersecting angle β of the primary spiral groove 1 and the secondary groove 2 is preferably, as shown in FIG. 2, in the range of 75° to 105°, and more preferably, they are intersected at a right angle.

Figure 4:
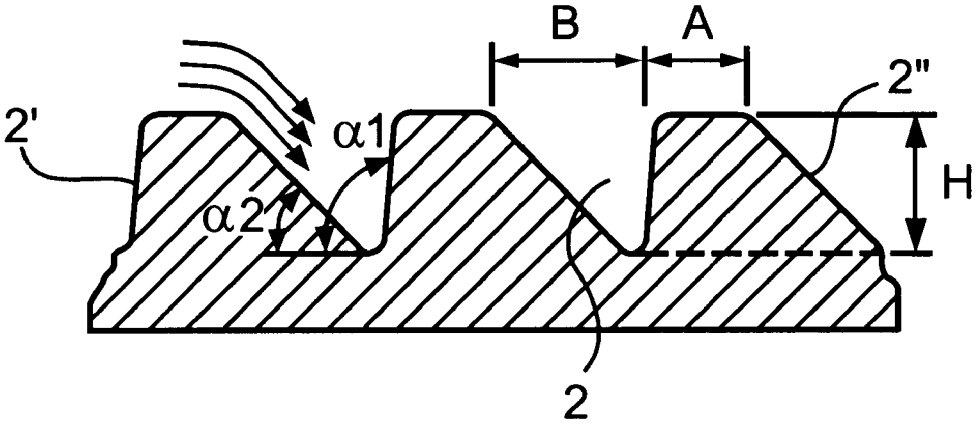
FIG. 4 is a cross sectional view taken along line IV—IV of FIG. 2 to show the cross sectional shape of secondary grooves.

In particular, the secondary groove 2 is formed in such a manner that the slope angle $\gamma_1$ of the upstream or front slant face 2' of the primary spiral groove 1 is larger than the slope angle $\gamma_2$ of the downstream or back slant face 2" to the flowing direction of the refrigerant fluid. Referring to FIG. 4, the slope angle $\gamma_1$ of the upstream slant face 2' is about a right angle, i.e., in the range of 90° to 105°, and the slope angle $\gamma_2$ of the downstream slant face 2" is in the range of 30° to 60°.

With the arrangement described above, the upstream slant face 2' with a large slope angle causes refrigerant fluid to produce outstanding turbulent flow and stirring action relative to the conventional tube. And, because the slope angle of the downstream slant face 2" is gradual, when the refrigerant fluid flows over the ridge 3, the refrigerant fluid moves gently along the downstream slant face 2" without producing eddy on the slant face 2", as will be described later. Therefore, the present invention can minimize the problem related to the conventional cross-grooved heat transfer tube, i.e., the pressure loss of the tube.

Referring to FIG. 4, the ratio A/B of a width A of the upper surface of the ridge 3 to a width B of the upper opening portion of the secondary groove 2 is preferably in the range of 0.2 to 1.0. If the ratio A/B is below 0.2, i.e., if the width A of the upper end face of the ridge 3 is very small, when the primary spiral grooves are machined after forming of the secondary grooves, the front face 2' of the ridge is slanted to the upstream direction. Accordingly, it is difficult to machine the slope angle of the secondary groove at a desired angle. Meanwhile, if the ratio A/B is above 1.0, i.e., if the width A of the upper surface of the ridge 3 is very large, the liquid film of the refrigerant fluid is diffused wide to the upper surface of the ridge, thereby deteriorating the condensation characteristic.

Preferably, the height Hf of the primary spiral groove and the height H of the secondary groove are equal. If the secondary groove is higher than the primary spiral groove, the turbulence effect produced by the primary spiral grooves and the surface tension on the grooves adversely affects the fluidity. Accordingly, the height of the secondary groove should be not higher than that of the primary spiral groove ($H/Hf \leqq 1.0$). Meanwhile, if the height of the secondary groove is low relative to the height of the primary spiral groove, heat transfer characteristics of the tube does not significantly vary from those of a conventional tube with spiral grooved inner surface. Therefore, the height of the secondary groove should be above at least ½ of the height of the primary spiral grooves($H/Hf \geqq 0.5$).

A method of manufacturing the cross-grooved heat transfer tube according to the present invention will now be described with reference to FIG. 5. The manufacturing method of the present invention is similar to the process of manufacturing heat transfer tube by electric-welding (see Japanese Unexamined Patent Publication No. 94-234014), except that the secondary grooves are roll-formed, prior to the formation of the primary spiral grooves. According to the conventional method, in which the primary spiral grooves are formed before the secondary grooves are formed, protrusions are protruded on both sides of the spiral grooves. It would be understood that the protrusions adversely affect the fluidity of the refrigerant fluid. However, the above problem can be effectively eliminated by the method of the present invention.

With respect to the method of manufacturing the cross-grooved heat transfer tube according to the present invention, the metal strip 5 having a width sufficient to manufacture the heat transfer tube with a given diameter is roll-swaged continuously by a secondary roll 6 for producing the secondary grooves 2, and then by a primary roll 7 for producing the primary grooves 1, the primary and secondary rolls having on the exterior surface of the rolls many parallel protruding sections oriented at an angle to the circumferential direction of the rolls. Because the secondary grooves have nearly right-angled triangles as described above, when the primary grooves are roll-swaged, the flow of molten from the pressing portions mainly contributes to the formation of the trapezoid ridges 3. Even if protrusions are protruded in a degree toward the secondary grooves, it can not deteriorate the effect of a superior fluidity produced by the primary spiral grooves. Further, the sharp protrusion protruding toward the secondary grooves may prevent effectively the refrigerant fluid from diffusing, resulting in improving the condensation characteristic.

After the completion of the roll-swaging operations to form secondary and primary grooves, the roll-formed metal strip is passed through a single roll or multi forming rolls 8 with the grooved surface in the interior of the tube. After passing through the shaping rolls of progressively smaller diameter, the strip is made into a long tube by seam welding the two longitudinal edges of the strip by high-frequency welding using induction coils 9. Then, the welded tube is passed through regular shaping rolls 10 for the shape of the circumference to form a perfect circle. And, the completed cross-grooved heat transfer tube is wound in the form of a coil or cut into desired lengths to be used as heat transfer tubes.

As discussed in the background, in the conventional spiral grooved tube, the refrigerant fluid fed into the tube becomes more widely distributed over the entire inner surface of the tube along the continuous helix grooves of the tube so that the refrigerant fluid cannot be widely directly contacted with the inner surface which leads to deterioration of condensation efficiency. By contrast, with the cross-grooved heat transfer tube manufactured by the present invention as described above, the condensation efficiency remains high, because the secondary grooves are formed at a desired angle to the primary spiral angle.

Further, the shape of the secondary grooves is formed in such a manner that one side wall is upstanding to the direction of the primary spiral groove and the other side wall is slanted at an angle to the direction of the primary spiral groove, as described above. Accordingly, the refrigerant fluid runs smoothly down along the slant face to prevent the eddy from being produced on the downstream slant faces of the ridges, so that the increase of the flowing resistance produced by the eddy and then the poor heat transfer characteristic may be reduced. Also, the upstream slant face of the ridges can cause the refrigerant fluid to maximize the turbulent production and the stirring action, thereby increasing the heat transfer characteristic. Because the bottom width of the ridge formed between the secondary grooves is relatively wide, when the heat transfer tube is used, the process of enlarging the tube may reduce the possibility of the breakage of the grooves or the ridges.

And, because of machining the secondary grooves prior to the primary spiral grooves, it can effectively prevent the protrusions from protruding towards the spiral grooves and adversely affecting the fluidity of the refrigerant fluid. Also the distribution of the refrigerant fluid can be prohibited by the sharp protrusions protruded towards the secondary grooves, thereby improving the vaporization capability.

Figure 6:
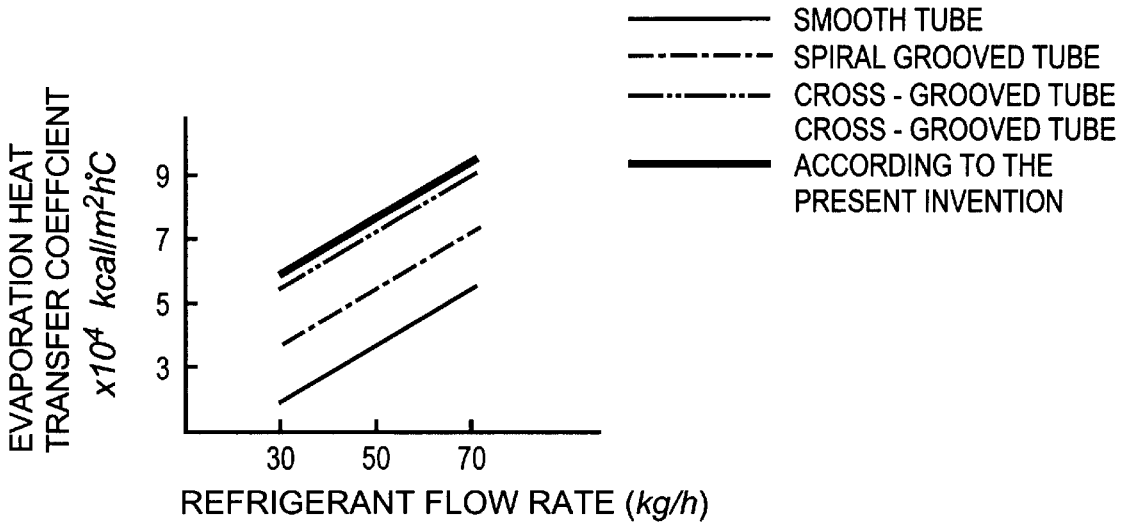
FIGS. 6 to 8 are graphs illustrating one example of test results to verify the performance of the cross-grooved heat transfer tube of 9.52 mm inner diameter according to the present invention in terms of the evaporation/condensation heat transfer capability and the pressure loss as compared with the conventional groove-free (smooth), spiral grooved and cross-grooved heat transfer tubes.
Figure 7:
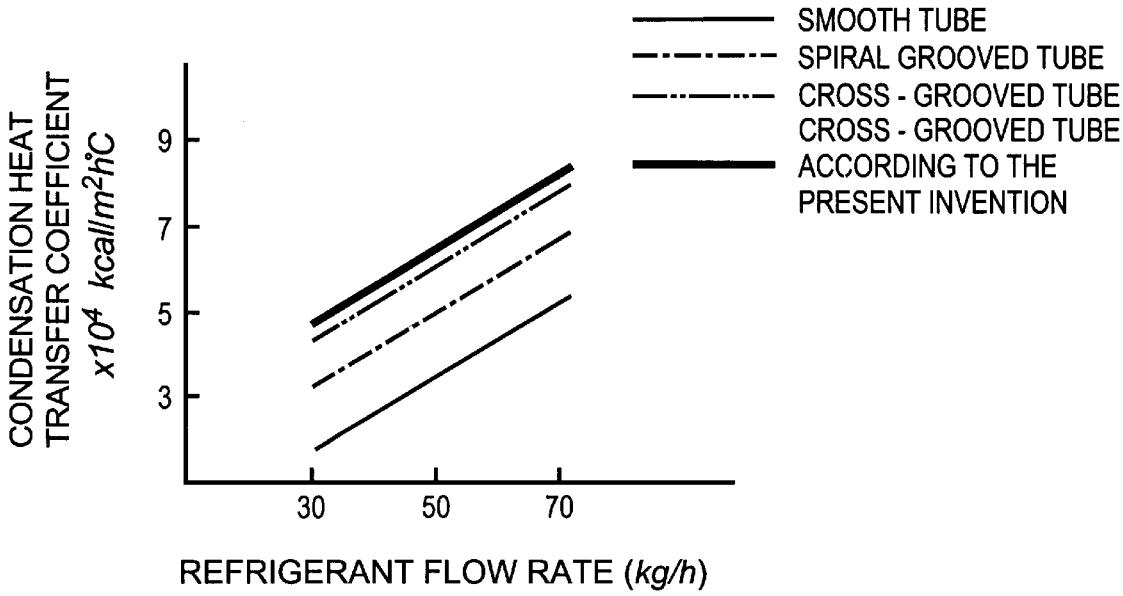
Figure 8:
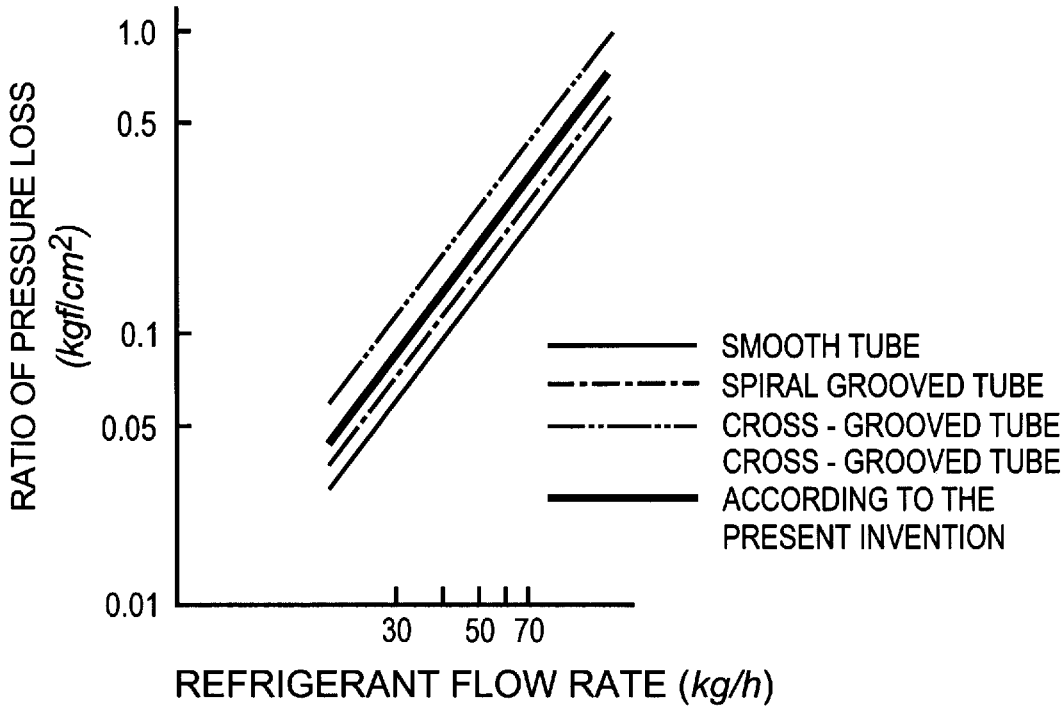
Figure 9A:
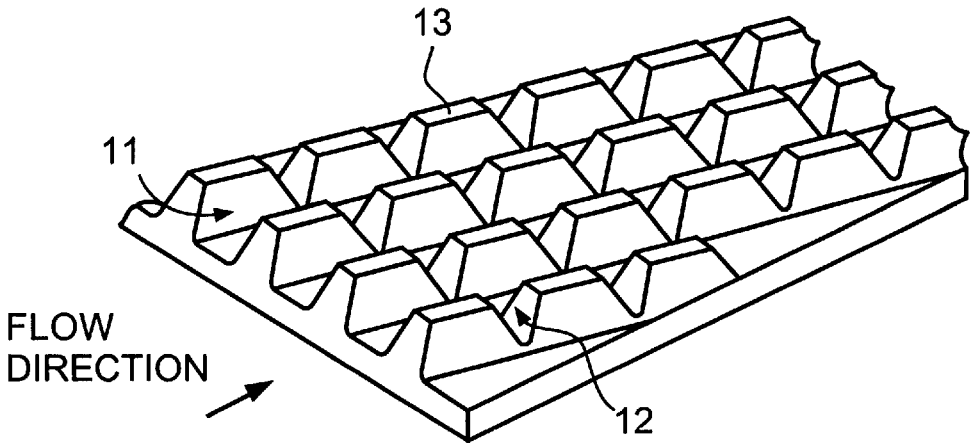
FIG. 9A (PRIOR ART)
FIG. 9A is a perspective view.
Figure 9B:
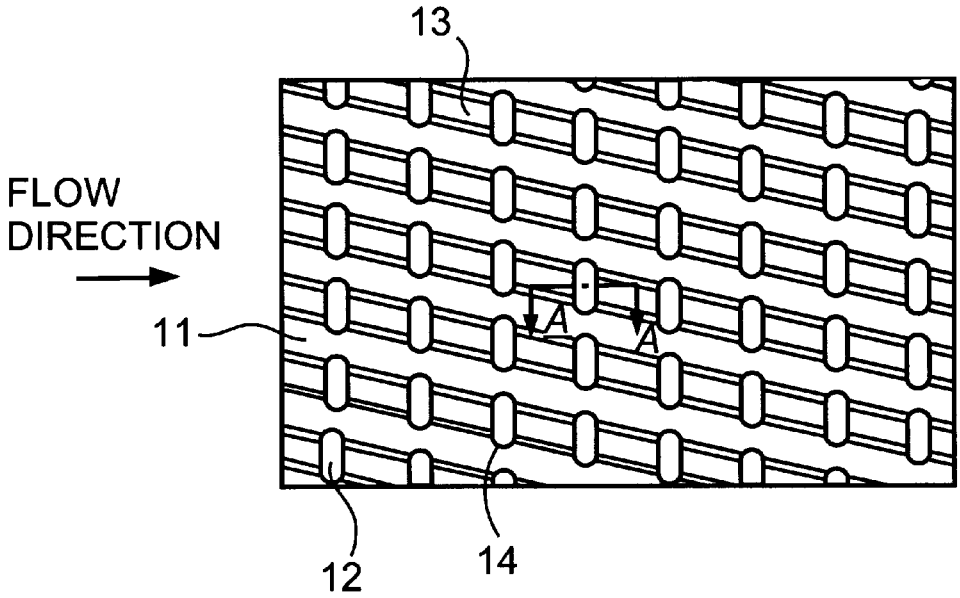
FIG. 9B (PRIOR ART)
FIG. 9B is a top plane view.
Figure 9C:
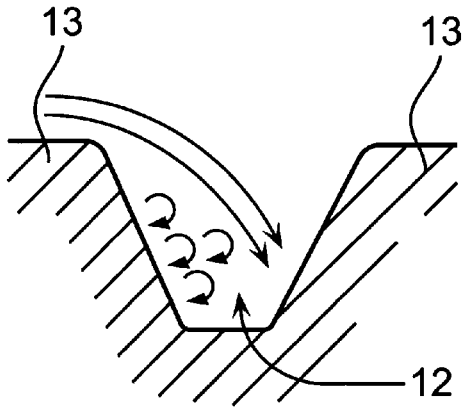
FIG. 9C (PRIOR ART)
FIG. 9C is a cross-sectional view taken along line A—A of FIG. 9B.

FIGS. 6 to 8 illustrate one example of test results to verify the effect of the copper cross-grooved heat transfer tube of 9.52 mm inner diameter according to the present invention in terms of the evaporation/condensation heat transfer capability and the pressure loss as compared with the conventional groove-free (smooth), spiral grooved and cross-grooved heat transfer tubes. The experimental tube of the present invention is produced in such a manner that the helix angle $\alpha$ of the primary spiral groove is 18°, the intersecting angle $\beta$ of the secondary groove to the primary spiral groove is 90°, the pitch P of the primary spiral groove is 0.24 mm, the ratio Hf/Di of the height Hf of the primary groove to inner diameter Di of the tube is 0.025, the ratio H/Hf of the height H of the secondary groove to the height Hf of the primary groove is 0.8, the slant angle $\gamma_1$ of the upstream slant face of the ridge is 90°, the slant angle $\gamma_2$ of the downstream slant face of the ridge is 30°, and the ratio A/B of the width A of the upper surface of the ridge 3 to the width B of the upper opening portion of the secondary groove is 0.5. The double tube type of the heat exchanges were produced by using the above heat transfer tubes, and refrigerant R22 were inflowed into the tubes to measure respective capability.

As can be seen from the test results of heat transfer characteristic in FIGS. 6 and 7, the heat transfer characteristic of the cross-grooved heat transfer tube according to the present invention was improved by a factor of about 3 times as compared with the conventional smooth tube and about 1.5 times as compared with the conventional spiral grooved tube, but is substantially equal to the conventional cross-grooved tube. In particular, the present tube was remarkably improved in terms of condensation characteristic as compared with the conventional cross-grooved tube.

Also, as can be seen from the test results of pressure characteristic in the tube with reference to FIG. 8, in spite of improving the heat transfer characteristic, the pressure loss in the tube according to the present invention is almost similar to that of the conventional spiral grooved heat transfer tube, and is reduced remarkably relative to the conventional cross-grooved heat transfer tube.

It would be appreciated that the cross-grooved heat transfer tube manufactured by the present invention can significantly improve the heat transfer characteristic such as the evaporation/condensation efficiency without increasing the pressure loss in the tube. Accordingly, it is possible to attain miniaturization, light-weight and cost reduction of the heat exchangers, as well as improve the performance of the heat exchanger such as condenser, evaporator and heat pipe, thereby saving energy.

While the present invention has been described and illustrated herein with reference to the preferred embodiment thereof, it will be understood by those skilled in the art that various changes in form and details may be made therein without departing from the spirit and scope of the invention.

What is claimed is:

1. A heat transfer tube with a cross-grooved inner surface comprising:

a plurality of primary spiral grooves spaced in parallel to each other at a helix angle to a longitudinal axis of the tube;

a plurality of secondary grooves spaced in parallel to each other and intersecting the primary spiral grooves at an intersecting angle to a direction of the primary spiral grooves to form a plurality of ridges between adjacent secondary grooves and adjacent primary spiral grooves; and the helix angle of the primary spiral groove to the longitudinal axis of the tube being in the range of 10° to 40°, and the intersecting angle of the secondary groove to the primary spiral groove being in the range of 75° to 105°;

the ridge having an upstream slant face at a nearly right angle to the direction of the primary spiral groove and a downstream slant face at an angle in the range of 30° to 60° to the direction of the primary spiral groove;

the ratio A/B of a width A of an upper surface of the ridge to a width B of an upper opening portion of the secondary groove being in the range of 0.2 to 1.0.

2. A heat transfer tube as claimed in claim 1, wherein a slope angle of the upstream slant face is in the range of 90° to 105° to the direction of the primary spiral groove.

3. A heat transfer tube as claimed in claim 1, wherein a ratio H/Hf of a height H of the secondary groove to a height Hf of the primary spiral groove is in the range of 0.5 to 1.0.

4. A heat transfer tube as claimed in claim 1, wherein the helix angle of the primary spiral groove to the longitudinal axis of the tube is in the range of 18° to 25°, and the intersecting angle of the secondary groove to the primary spiral groove is substantially 90°.

* * * * *